US008348599B2

(12) United States Patent
Chiu et al.

(10) Patent No.: US 8,348,599 B2
(45) Date of Patent: Jan. 8, 2013

(54) TURBINE ROTOR WHEEL

(75) Inventors: Ya-Tien Chiu, Greer, SC (US); Venkata Siva Chaluvadi, Simpsonville, SC (US); Matthew Ryan Ferslew, Johnson City, TN (US)

(73) Assignee: General Electric Company, Schenectady, NY (US)

( * ) Notice: Subject to any disclaimer, the term of this patent is extended or adjusted under 35 U.S.C. 154(b) by 526 days.

(21) Appl. No.: 12/732,729

(22) Filed: Mar. 26, 2010

(65) Prior Publication Data

US 2011/0236190 A1 Sep. 29, 2011

(51) Int. Cl.
*F01D 5/02* (2006.01)

(52) U.S. Cl. ..... 415/144; 415/115; 415/117; 415/145; 415/208.2; 416/236 R

(58) Field of Classification Search ..... 415/115, 415/116, 117, 144, 145, 157, 208.2; 416/235, 416/236 R See application file for complete search history.

(56) References Cited

U.S. PATENT DOCUMENTS

| | | | | |
|---|---|---|---|---|
| 2,618,433 | A * | 11/1952 | Loos et al. | 415/115 |
| 3,742,706 | A * | 7/1973 | Klompas | 60/726 |
| 4,127,988 | A * | 12/1978 | Becker | 60/726 |
| 4,415,310 | A * | 11/1983 | Bouiller et al. | 416/95 |
| 4,595,339 | A * | 6/1986 | Naudet | 416/95 |
| 5,997,244 | A * | 12/1999 | Gebre-Giorgis et al. | 415/115 |
| 6,398,487 | B1 * | 6/2002 | Wallace et al. | 415/115 |
| 6,663,346 | B2 * | 12/2003 | Munsell et al. | 416/97 R |
| 7,708,519 | B2 * | 5/2010 | Mignano | 415/157 |
| 2011/0236190 | A1 * | 9/2011 | Chiu et al. | 415/177 |
| 2012/0201669 | A1 * | 8/2012 | Mallaiah et al. | 415/209.1 |

* cited by examiner

*Primary Examiner* — Igor Kershteyn
*Assistant Examiner* — Christopher R Legendre
(74) *Attorney, Agent, or Firm* — Cantor Colburn LLP

(57) ABSTRACT

A rotor wheel is provided and includes a body having first and second opposing faces and portions recessed from a plane of the first face to define therein an annular groove and a plurality of tributary grooves, the annular groove being receptive of fluid from an external source and formed to direct the fluid to flow along an annular flow path, and the plurality of tributary grooves being receptive of the fluid from the annular groove and respectively formed to direct the fluid to flow sequentially along radial and axial tributary flow paths while preventing inter-tributary groove fluid communication.

20 Claims, 2 Drawing Sheets

TURBINE ROTOR WHEEL

BACKGROUND OF THE INVENTION

The subject matter disclosed herein relates to turbine rotor wheels.

In a turbine engine, such as a gas turbine engine, cooling flows for the rotating turbine blades are extracted from air within a hub of a compressor section. Once this air is pulled off from the hub and into rotating machinery domains, typical practice is to design a passage to allow the air to flow radially deeper toward a rotation centerline. The goal of such passage design is to ensure that the flow of the air rotates at a similar speed as the machinery components so losses can be reduced when the flow direction is changed.

With these goals in mind, passage design often yields circuits in which ends of relatively short radial inflow passages are characterized by full 360-degree continuous chambers and a given number of long "gun holes" extending axially toward the turbine. In this way, the passage design results in less pressure loss across the passage and provides freedom to mechanical designers to place the gun hole entrances at a relatively high radius so they can pursue superior robustness and reliability.

BRIEF DESCRIPTION OF THE INVENTION

According to one aspect of the invention, a rotor wheel is provided and includes a body having first and second opposing faces and portions recessed from a plane of the first face to define therein an annular groove and a plurality of tributary grooves, the annular groove being receptive of fluid from an external source and formed to direct the fluid to flow along an annular flow path, and the plurality of tributary grooves being receptive of the fluid from the annular groove and respectively formed to direct the fluid to flow sequentially along radial and axial tributary flow paths while preventing inter-tributary groove fluid communication.

According to another aspect of the invention, a rotor wheel is provided and includes a body rotatable about a rotation centerline and having first and second opposing faces, portions of the body being recessed from a plane of the first face to define therein outer and inner annular grooves and a plurality of tributary grooves, the outer annular groove being receptive of a fluid from an external source and formed to direct the fluid to flow about the rotation centerline, the plurality of tributary grooves being receptive of the fluid from the annular groove and respectively formed to direct the fluid to flow radially inwardly, and the inner annular groove being receptive of the fluid from the tributary grooves and formed to direct the fluid to sequentially flow in radial and axial directions while substantially preventing the fluid from flowing about the rotation centerline.

According to yet another aspect of the invention, a turbine engine is provided and includes a compressor hub having a rotation centerline, a body rotatable about the rotation centerline and having first and second opposing faces, portions of the body being recessed from a plane of the first face to define therein an annular groove, which is receptive of compressor hub fluid and directs the fluid to flow about the rotation centerline, and a plurality of tributary grooves, which are receptive of the fluid from the annular groove and respectively direct the fluid to flow in a radial and then an axial direction while preventing inter-tributary groove fluid communication and a downstream section, aft of and adjacent to the first face, which is formed to define holes receptive of the fluid from the tributary grooves extending along the axial direction.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Where a relatively short radially inward inflow passage is employed, and when the more energized flow enters into a free-vortex connection region between the radial passage and an axial gun hole, the flow can proceed around the free-vortex region instead of proceeding directly toward the gun hole nearest to the passage where it has just left. If there is any perturbation in a driving pressure, instabilities may occur as the flow continues around the free-vortex region to find a suitable gun hole. This may block the flow entering a turbine and may cause backflow outward through one or more of the radial passages.

Figure 1:
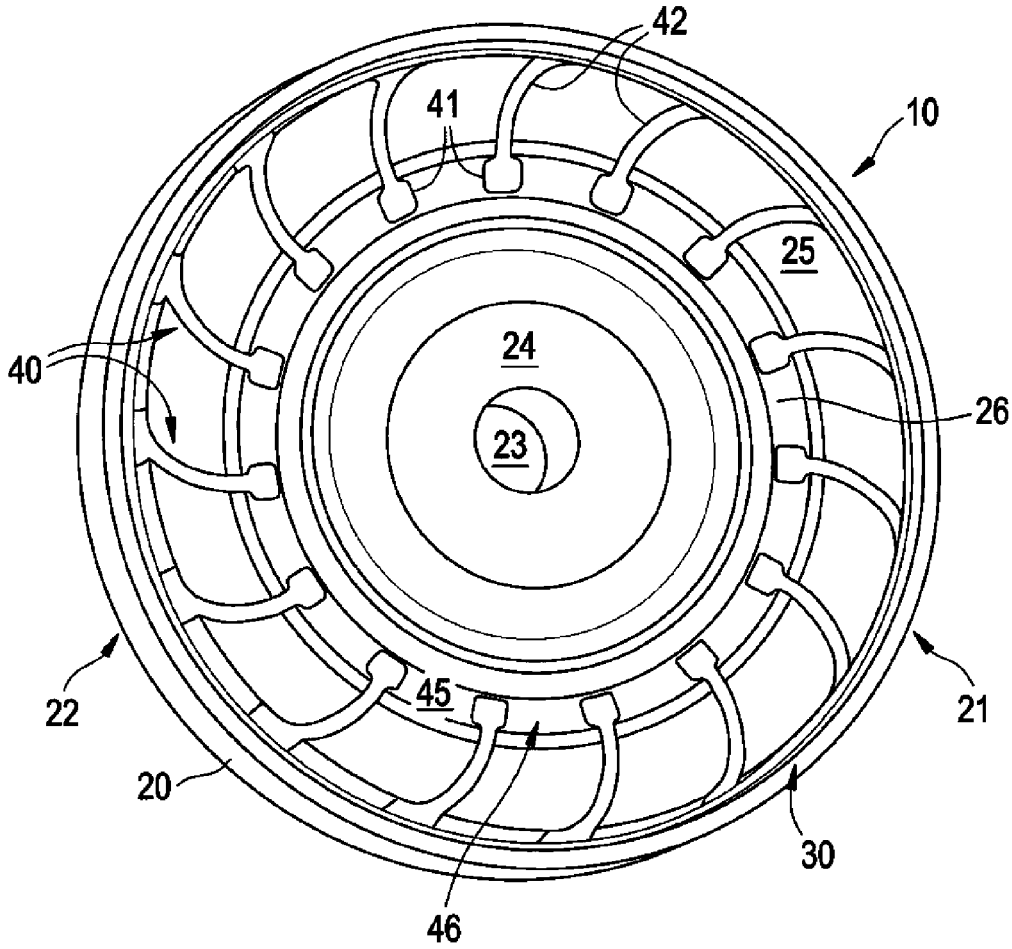
FIG. 1 is a perspective view of a turbine engine rotor wheel.
Figure 2:
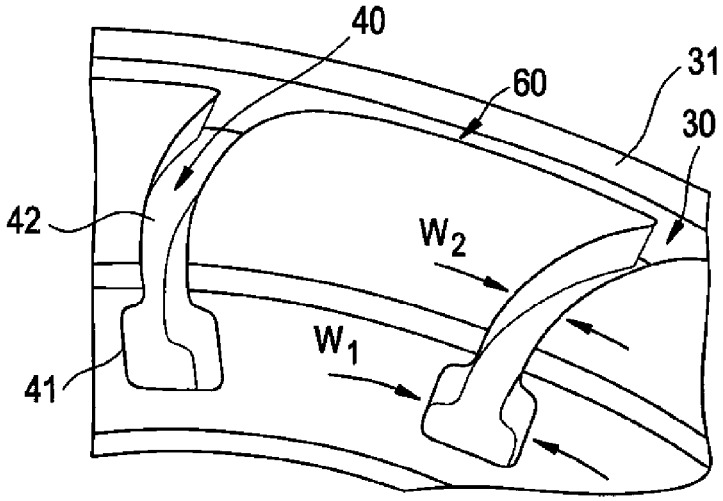
FIG. 2 is an enlarged perspective view of the turbine engine rotor wheel of FIG. 1.
Figure 3:
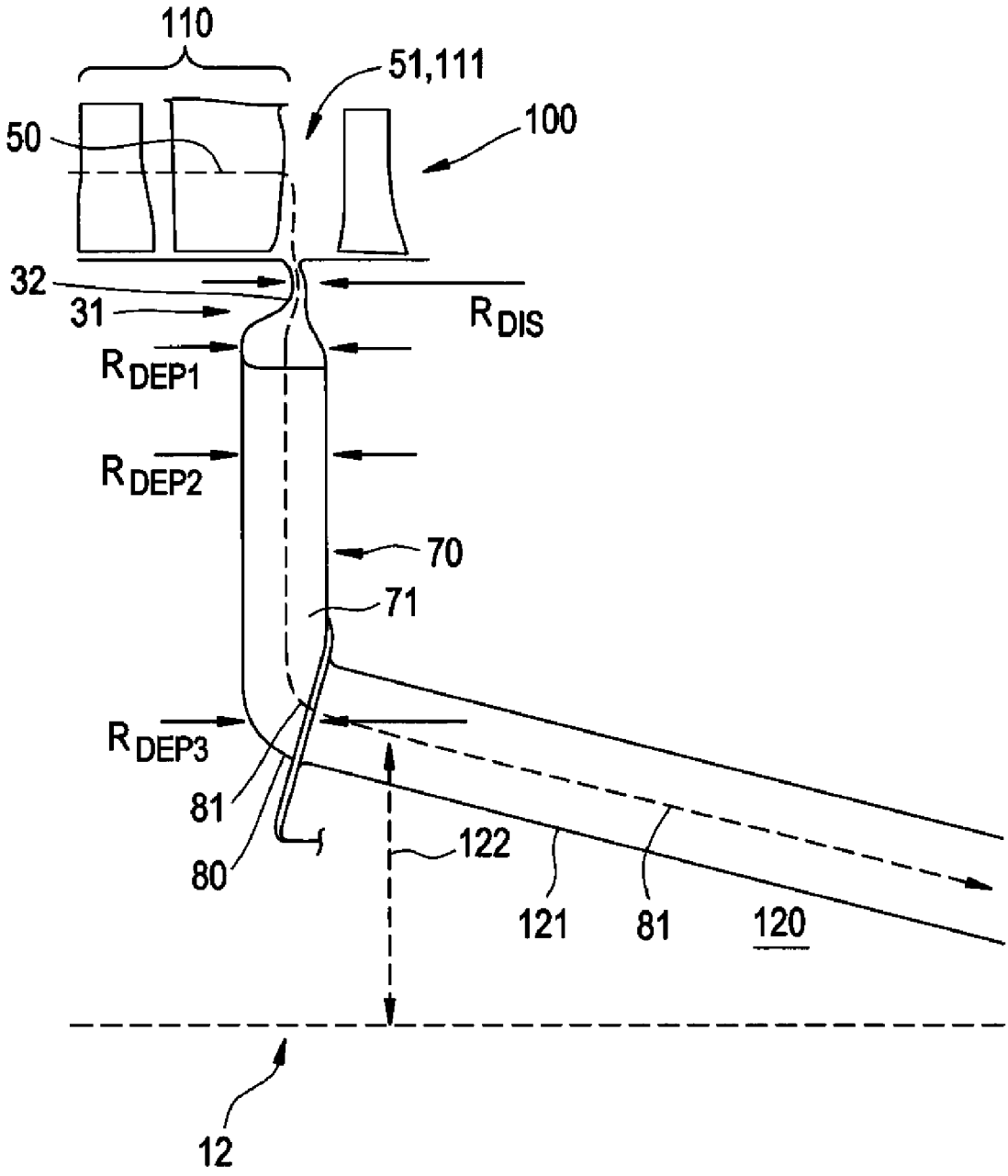
FIG. 3 is a side sectional view of the turbine engine rotor wheel.

The free vortex region can be removed to eliminate risk of flow instability and to allow for a short radial inflow passage design that improves performance, robustness, and reliability of a turbine engine. With reference to FIGS. 1-3, a rotor wheel 10 is provided and includes a body 20 that is substantially disk-shaped and has a first face 21 and a second face 22, which oppose one another. An aperture 23 is formed at a center portion 24 of the body 20, which corresponds to a rotation centerline 12 about which the rotor wheel 10 is rotatable. The aperture 23 extends between the first face 21 and the second face 22. Portions of the rotor wheel 10 are recessed from a plane of the first face 21 and define within the body 20 an annular groove 30 and a plurality of tributary grooves 40.

The annular groove 30 is receptive of fluid 50 from an external source 51 and directs the fluid 50 to flow along an annular flow path 60, which is disposed perimetrically around the rotation centerline 12. The annular groove 30 is defined at an outer radial portion 25 of the body 20. The tributary grooves 40 extend from the outer radial portion 25 and toward a mid-section 26 radially interposed between the outer radial portion 25 and the center portion 24.

The annular groove 30 is delimited at an outer extent thereof by an annular rim 31. The annular rim 31 protrudes from the body 20 and has a summit 32. The summit 32 is recessed from the plane of the first face 21 by a predefined recess distance, $R_{DIS}$. The fluid 50 may be extracted from the external source 51, such as a rotor-stator-rotor assembly of a compressor hub, and enters the annular groove 30 in an inwardly radial direction defined along the summit 32.

The plurality of tributary grooves 40 are each fluidly communicative with the annular groove 30 and thereby receptive of the fluid 50. Each of the tributary grooves 40 are also respectively formed to direct the fluid 50 to flow in sequential radial and axial directions 71 and 81, respectively, along a radial tributary flow path 70 and then an axial tributary flow path 80. The tributary grooves 40 are further formed to substantially prevent inter-tributary groove fluid communication. That is, the fluid 50 is prevented from flowing radially inwardly along one tributary groove 40 and then circumferentially to another tributary groove 40. Instead, the fluid 50 is forced to flow radially inwardly along each of the tributary grooves 40 and then in axially aft directions away from the body 20.

As shown in FIGS. 1 and 2, the tributary grooves 40 may spiral inwardly from the outer radial portion of the body 20 and toward the mid-section 26 so that the fluid 50 can enter the tributary grooves 40 by flowing in a direction similar to its flow direction in the annular groove 30. Each of the tributary grooves 40 has an inner radial portion 41 and an outer radial portion 42. A recess depth of the annular groove 30, $R_{DEP1}$, is similar to a recess depth of the outer radial portions 42, $R_{DEP2}$. By comparison, recess depths at the inner radial portions 41, $R_{DEP3}$, gradually decrease. Concurrently, a width, $W_1$, of the inner radial portions 41 is greater than a width, $W_2$, of the outer radial portions 42.

The axial direction 81 is obliquely angled with respect to the rotation centerline 12 and permits the tributary grooves 40 to terminate at the mid-section 26. The axial direction 81 is further directed in an aft direction and proceeds away from the body 20 such that the fluid 50 can flow downstream toward, for example, a turbine.

In accordance with another aspect of the invention, the inner radial portions 41 of the tributary groove 40 can be defined as an inner annular groove 45. Here, the inner annular groove 45 is receptive of the fluid 50 from the tributary grooves 40 and directs the fluid to sequentially flow in the radial and axial directions 71 and 81. At the same time, the inner annular groove 45 substantially prevents the fluid 50 from flowing about the rotation centerline 12. This flow prevention may be accomplished by flow blocking members 46 disposed within the inner annular groove 45. The flow blocking members 46 sit within the inner annular groove 45 and are impervious to the fluid 50 to thereby impede the flow thereof about the rotation centerline 12.

In accordance with another aspect of the invention, a turbine engine 100, such as a gas turbine engine, is provided. The turbine engine 100 includes a compressor hub 110 having a rotation centerline 12, a body 20 as described above, and a downstream section 120. The downstream section 120 is disposed aft of and adjacent to the first face 21 and is formed to define gun holes 121 extending along the axial direction 81. The compressor hub 110 may include the external source 51, which may be embodied as a rotor-stator-rotor assembly 111. In this case, the fluid 50 may be coolant extracted from the rotor-stator-rotor assembly 111. The gun holes 121 are substantially straight and extend in a direction with a radial component 122 from the tributary grooves 40 toward the rotation centerline 12.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A rotor wheel, comprising:

a body having first and second opposing faces and portions recessed from a plane of the first face to define therein an annular groove and a plurality of tributary grooves, the annular groove being receptive of fluid from an external source and formed to direct the fluid to flow along an annular flow path, and the plurality of tributary grooves being receptive of the fluid from the annular groove and respectively formed to direct the fluid to flow sequentially along radial and axial tributary flow paths while preventing inter-tributary groove fluid communication.

2. The rotor wheel according to claim 1, wherein the body is substantially disk-shaped with an aperture extending between the first and second faces.

3. The rotor wheel according to claim 2, wherein the annular groove is defined at an outer radial portion of the body and the tributary grooves extend from the outer radial portion to a mid-section between the outer radial portion and the aperture.

4. The rotor wheel according to claim 1, wherein the annular groove is delimited at an outer extent thereof by an annular rim having a summit recessed from the first face.

5. The rotor wheel according to claim 1, wherein the fluid is extracted from a compressor rotor-stator-rotor assembly.

6. The rotor wheel according to claim 5, wherein the fluid enters the annular groove in an inwardly radial direction.

7. The rotor wheel according to claim 1, wherein the tributary grooves are spirals.

8. The rotor wheel according to claim 1, wherein each of the tributary grooves has an inner and an outer radial portion.

9. The rotor wheel according to claim 8, wherein recess depths of the annular groove and the outer radial portions of the tributary grooves are similar.

10. The rotor wheel according to claim 8, wherein recess depths of the tributary grooves at the inner radial portions gradually decrease.

11. The rotor wheel according to claim 8, wherein a width of the inner radial portions of the tributary grooves is greater than that of the outer radial portions.

12. The rotor wheel according to claim 1, wherein the axial tributary flow path is directed with an axial component oblique with respect to a rotation centerline about which the body is rotatable.

13. The rotor wheel according to claim 12, wherein the axial component is directed aft from the body.

14. A rotor wheel, comprising:

a body rotatable about a rotation centerline and having first and second opposing faces, portions of the body being recessed from a plane of the first face to define therein outer and inner annular grooves and a plurality of tributary grooves, the outer annular groove being receptive of a fluid from an external source and formed to direct the fluid to flow about the rotation centerline, the plurality of tributary grooves being receptive of the fluid from the annular groove and respectively formed to direct the fluid to flow radially inwardly, and the inner annular groove being receptive of the fluid from the tributary grooves and formed to direct the fluid to sequentially flow in radial and axial directions while substantially preventing the fluid from flowing about the rotation centerline.

15. The rotor wheel according to claim 14, wherein the inner annular groove is defined with flow blocking members to block the flow about the rotation centerline.

16. A turbine engine, comprising:

a compressor hub having a rotation centerline;

a body rotatable about the rotation centerline and having first and second opposing faces, portions of the body being recessed from a plane of the first face to define therein an annular groove, which is receptive of compressor hub fluid and directs the fluid to flow about the rotation centerline, and a plurality of tributary grooves, which are receptive of the fluid from the annular groove and respectively direct the fluid to flow in a radial and then an axial direction while preventing inter-tributary groove fluid communication; and a downstream section, aft of and adjacent to the first face, which is formed to define holes receptive of the fluid from the tributary grooves extending along the axial direction.

17. The turbine engine according to claim 16, wherein the compressor hub comprises a rotor-stator-rotor assembly.

18. The turbine engine according to claim 17, wherein the compressor hub fluid comprises coolant extracted from the rotor-stator-rotor assembly.

19. The turbine engine according to claim 16, wherein the holes are substantially straight.

20. The turbine engine according to claim 16, wherein the holes extend in a radial direction from the tributary grooves toward the rotation centerline.

* * * * *